United States Patent [19]

Gullion

[11] Patent Number: 4,759,409

[45] Date of Patent: Jul. 26, 1988

[54] SUBSEA WELLHEAD SEAL ASSEMBLY

[75] Inventor: Steven D. Gullion, Houston, Tex.

[73] Assignee: Cameron Iron Works USA, Inc., Houston, Tex.

[21] Appl. No.: 44,411

[22] Filed: Apr. 30, 1987

[51] Int. Cl.[4] ..... E21B 33/043

[52] U.S. Cl. ..... 166/348; 166/182; 166/196; 166/208; 277/117; 277/205; 277/236; 285/139; 285/382.4

[58] Field of Search ..... 166/348, 85, 206, 208, 166/217, 182, 195, 196; 285/329, 352, 351, 382, 382.4, 382.5, 139, 315; 277/236, 205, 206 A, 116.8, 116.6, 116.4, 102, 117, 125, 124, 123

[56] References Cited

U.S. PATENT DOCUMENTS

| | | | |
|---|---|---|---|
| 2,456,081 | 12/1948 | Penick | 277/124 |
| 2,956,822 | 10/1960 | Kates | 285/139 X |
| 4,131,287 | 12/1978 | Gunderson et al. | 277/236 X |
| 4,353,420 | 10/1982 | Miller | 166/182 X |
| 4,353,560 | 10/1982 | Tohill | 277/124 X |
| 4,384,726 | 5/1983 | Meyer | 277/117 X |
| 4,588,030 | 5/1986 | Blizzard | 277/236 X |
| 4,595,053 | 6/1986 | Watkins et al. | 166/209 |

*Primary Examiner*—Stephen J. Novosad
*Assistant Examiner*—Hoang C. Dang
*Attorney, Agent, or Firm*—Vinson & Elkins

[57] ABSTRACT

An improved subsea wellhead seal assembly include an annular body having a pair of lower annular skirts, one extending downwardly and outwardly and the other extending downwardly and inwardly, a lower landing ring and means movably securing the lower landing ring to the annular body so that, when the lower landing ring is landed, the annular body continues its downward movement to deform the annular skirts outwardly and inwardly into sealing engagement with the walls of the annulus. A reaction ring is provided above landing ring for engagement by the ends of skirts and spacer rings may be used to preselect the level of the sealing surface engagement by the skirts.

8 Claims, 3 Drawing Sheets

SUBSEA WELLHEAD SEAL ASSEMBLY

BACKGROUND

The present invention relates to an improved subsea wellhead seal assembly. Wellhead seals have included resilient annulus seals which are compressed axially to deform radially into sealing engagement with the walls of the annular space. U.S. Pat. No. 3,797,864 is an example of such a resilient annular wellhead seal.

Other annular seals have utilized wedging elements to force legs into sealing engagement with the walls of the annulus. U.S. Pat. Nos. 4,195,865 and 4,488,740 disclose resilient seals of this type and U.S. Pat. Nos. 4,131,287 and 4,595,053 disclose metal-to-metal seals of this type.

Other seals have involved using Belleville washers which in unset position assume their usual dished shape and in their set position they are forced into a flatter shape so that their inner and outer edges are forced into engagement with the walls of the annular space. This type of seal is illustrated in U.S. Pat. No. 4,082,105.

SUMMARY

The improved subsea wellhead seal assembly of the present invention includes an annular body having a pair of lower annular skirts, one extending downwardly and outwardly and the other extending downwardly and inwardly, a lower landing ring and means movably securing the lower landing ring to the annular body so that, when the lower landing ring is landed, the annular body continues its downward movement to deform the annular skirts outwardly and inwardly into sealing engagement with the walls of the annulus.

An object of the present invention is to provide an improved subsea wellhead seal assembly which provides a simple but effective metal-to-metal seal.

Another object is to provide an improved subsea wellhead seal assembly in which the seal is provided by the sealing lips digging into the walls of the annulus being sealed.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
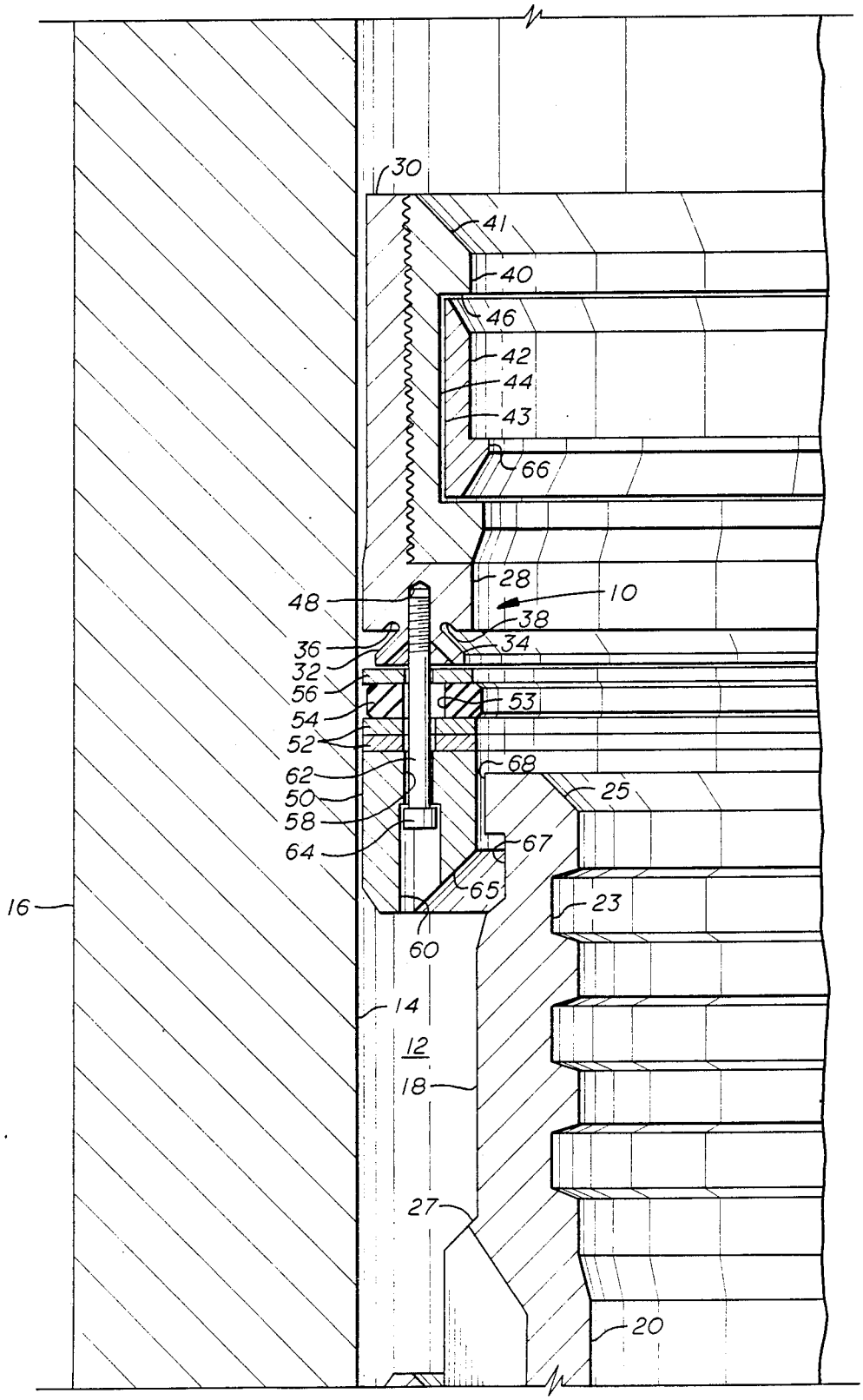
FIG. 1 is a detail partial sectional view of the improved seal assembly is being lowered into the annulus in which it is to provide an annular seal with the tool on which it is run being omitted.
Figure 2:
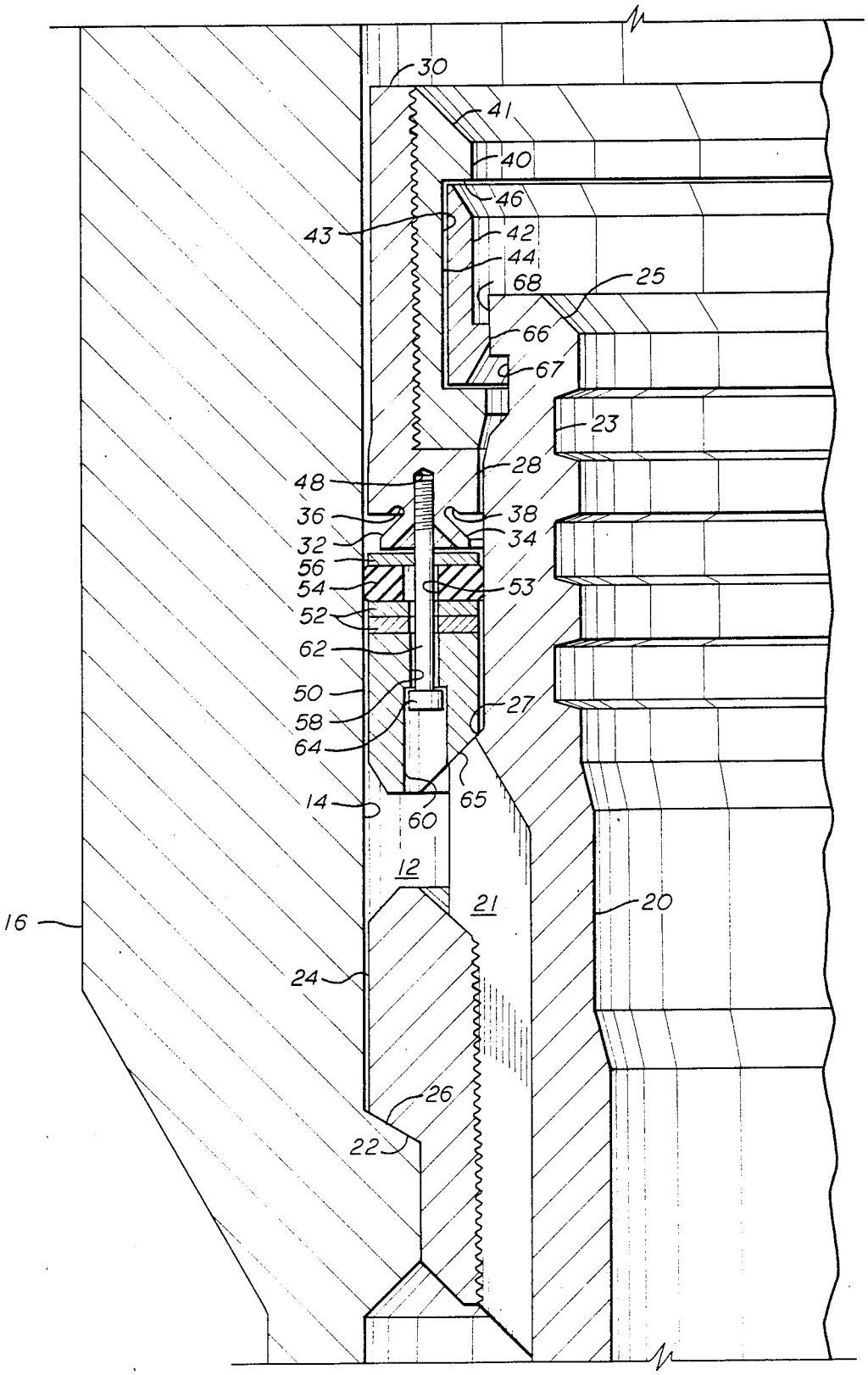
FIG. 2 is a detail partial sectional view of the improved seal assembly landed within the annulus between the hanger and the wellhead housing.

Improved seal assembly 10 of the present invention is shown in FIG. 1 being run into annular space 12 between the interior sealing surface 14 of subsea wellhead housing 16 and exterior sealing surface 18 on hanger 20. Hanger 20 is shown in FIG. 2 with landing shoulder 22 on hanger landing ring 24 in engagement with landing seat 26 on the interior of wellhead housing 16. Hanger 20 includes mud slots 21 through which well bore returns may be taken during the cementing or other operations. Hanger landing ring 24 is threadedly attached to the outer diameter of hanger 20 in the area of mud slots 21. Hanger 20 also includes upwardly facing shoulder 27 which forms the landing seat for seal assembly 10 within annulus 12. Hanger 20 also includes preparation 23 for receiving a suitable tool for running hanger 20 into housing 16 and an upwardly facing landing shoulder 25 for receiving additional hangers which may be needed.

Seal assembly 10 includes annular body 28 having upstanding outer rim 30, lower downwardly and outwardly flaring skirt 32 and lower downwardly and inwardly flaring skirt 34 with undercut groove 36 on the outer side of skirt 32 and undercut groove 38 on the inner side of skirt 34. The interior upstanding rim 30 is threaded to receive insert 40 which holds split locking ring 42 in internal recess 43. Locking ring 42 is biased inwardly of interior surface 44 of internal recess 43 in insert 40 to the locked position shown in FIG. 3. Annular body 28 has threaded openings 48 extending upwardly between skirts 32 and 34. Seal assembly 10 also includes annular landing ring 50 with spacer rings 52, wiper ring 54 and reaction ring 56 stacked thereon as shown. A plurality of bores 58 extend through landing ring 50 and counterbores 60 extend out the lower end of landing ring 50. Openings extend through spacer rings 52, wiper ring 54 and reaction ring 56 to allow cap screws 62 to extend therethrough with their heads 64 within counterbores 60 and having their upper ends threaded into threaded openings 48. Thus cap screws 62 provide the means for retaining the components of seal assembly 10 assembled during running and use. Landing surface 65 on the lower end of landing ring 50 is tapered to mate with landing shoulder 27 on hanger 20. Opening 53 through wiper ring 54 is slotted as shown to allow wiper ring 54 to engage surface 18 around hanger 20 as seal assembly 10 enters annular space 12. This engagement forces wiper ring 54 outward into engagement with sealing surface 14 within housing 16. Thus, as seal assembly 10 moves into annular space 12, wiper ring 54 wipes sealing surfaces 14 and 18 to ensure better surfaces against skirts 32 and 34 are to seal.

Figure 3:
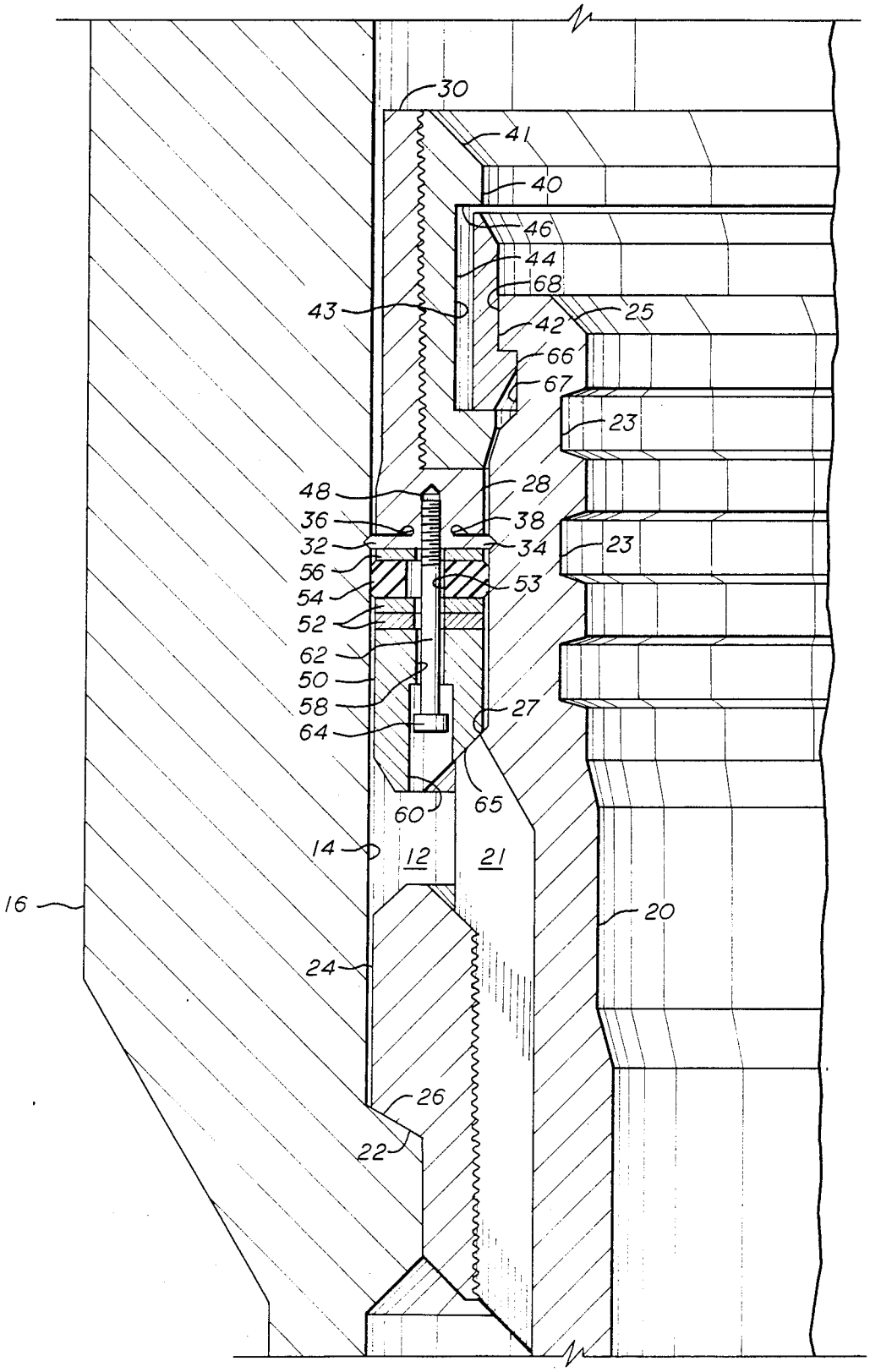
FIG. 3 is a detail partial sectional view of the improved seal assembly in set position sealing across the annulus between the hanger and the wellhead housing.

When seal assembly 10 has been landed within annulus 12, the running tool (not shown) forces seal assembly 10 downward while holding lock ring 42 within recess 43 so that its inner projection 66 passes about upper outer flange 68 on hanger 20. After seal assembly 10 has landed on shoulder 27, of hanger 20, further downward movement of the running tool is transmitted to skirts 32 and 34. The force of this movement causes skirts 32 and 34 to bend upwardly with outer skirt 32 bending outwardly and inner skirt 34 bending inwardly. As soon as skirts 32 and 34 have bent sufficiently to dig into sealing surfaces 14 and 18, some of the load is transferred to help the engagement of the skirts with the sealing surfaces and further movement brings the skirts into relatively horizontal positions as shown in FIG. 3 with their outer edges digging into sealing surfaces 14 and 18 in tight gripping and sealing engagement therewith. The smooth transition of the bending of skirts 32 and 34 is assisted by grooves 36 and 38 at the roots of the skirts. The digging engagement of the skirts into the sealing surfaces provides a positive metal-to-metal seal. When seal assembly 10 is set, locking ring 42 enters into engagement with groove 67 on the upper exterior of hanger 20 to retain seal assembly 10 in such set position.

This engagement as shown in FIG. 3 locks seal assembly 10 in its set and sealed position.

Spacer rings 52 are included so that in the event a first setting of seal assembly 10 is subjected to leaks, the seal may be recovered and one of the spacer rings 52 removed. This allows seal assembly 10 to be run into annulus 12 again and set and reset, with such resetting being in a different area of sealing surfaces 14 and 18. In this way sealing is not made more difficult by the prior indentations made by the prior sealing attempts and the skirts 32 and 34 engage virgin sealing surfaces.

Wiper ring 54 is preferably made of nylon and can be either solid or a radially split ring. It is preferred that the outer edge of wiper ring 54 be recessed slightly during running so that it is not damaged and does not catch on irregularities within the string through which it is run. Reaction ring 56 is preferred to be of a hard surface metal which is not easily damaged so that the pivoting of skirts 32 and 34 is a smooth sliding of the ends of the skirts on the upper surface of reaction ring 56. The ends of skirts 32 and 34 are beveled to provide a central ridge which is to engage the sealing surfaces 14 and 18 and a flat surface which initially engages the upper surface of reaction ring 56.

What is claimed is:

1. An annular subsea wellhead seal assembly for sealing against the walls in a subsea wellhead annulus above a landing seat at the lower end of the annulus comprising an annular body having an outwardly and downwardly flaring outer skirt and an inwardly and downwardly flaring inner skirt extending from its lower surface, a landing ring having lower landing surface for landing on a landing seat at the lower end of the subsea wellhead annulus in which the assembly is to seal, and an upper flat reaction surface which is positioned immediately under and engagable with the lower ends of said skirts, and means connecting said body and said landing ring for relative movement toward each other, downward movement of said body with respect to said landing ring spreading said skirts outward and inward, respectively, into a substantially horizontal digging engagement set position with the walls of the annulus to be sealed.

2. An annular subsea wellhead seal assembly according to claim 1 including a locking ring carried by said body and adapted to lock said assembly in set position.

3. An annular subsea wellhead seal assembly according to claim 1 including a reaction ring positioned above said landing ring to provide said upper flat reaction surface.

4. An annular subsea wellhead seal according to claim 3 including a wiper ring positioned above said landing ring and below said reaction ring to wipe the walls of the annulus in which the assembly is to be set.

5. An annular subsea wellhead seal assembly according to claim 3 including at least one spacer ring positioned between said landing ring and said reaction ring.

6. An annular subsea wellhead seal assembly according to claim 1 wherein said connecting means includes a plurality of screws extending through said landing ring and threading into said body at positions between said skirts.

7. An annular subsea wellhead seal assembly according to claim 6 including a bore through said landing ring, and a counterbore extending partially upward in said landing ring, said screws extending through said bore and having their heads within said counterbore to limit separation of the body and landing ring but allowing relative movement of the body and the landing ring toward each other.

8. An annular subsea wellhead seal assembly according to claim 2 including an insert ring secured to said body and having an internal recess in which said locking ring is positioned during running.

* * * * *